United States Patent [19]

McCain et al.

[11] Patent Number: 4,537,342

[45] Date of Patent: Aug. 27, 1985

[54] BINDING MACHINE FOR A SIGNATURE MACHINE

[75] Inventors: William B. McCain, Hinsdale, Ill.; George D. Higgins, Kansas City, Mo.

[73] Assignee: McCain Manufacturing Corporation, Chicago, Ill.

[21] Appl. No.: 545,217

[22] Filed: Oct. 26, 1983

[51] Int. Cl.[3] ..... B27F 7/28

[52] U.S. Cl. ..... 227/78; 227/156

[58] Field of Search ..... 227/8, 78, 120, 156

[56] References Cited

U.S. PATENT DOCUMENTS 2,999,242 9/1961 Young et al. ..... 227/78 X

FOREIGN PATENT DOCUMENTS 0012737 6/1970 European Pat. Off. ..... 227/78

2068287 8/1981 United Kingdom ..... 227/78

*Primary Examiner*—Paul A. Bell

*Attorney, Agent, or Firm*—Kinzer, Plyer, Dorn & McEachran

[57] ABSTRACT

A signature machine for assembling books has a binding machine which can accommodate variable book thicknesses without adjustment during operation. The binding machine has multiple binding stations each of which is pre-set to bind a book of a particular thickness. Each book is bound at the station set up to operate on the corresponding book thickness. The stations are disabled when presented with books of thickness different from that assigned to the particular station.

4 Claims, 5 Drawing Figures

BINDING MACHINE FOR A SIGNATURE MACHINE

BACKGROUND OF THE INVENTION

This invention relates to signature gathering machines in which successive signatures are fed to and collected into a book on a conveyor.

Books, including magazines, are composed of signatures which are simply folded sheets bearing the printed matter. The signature may present pages of the usual kind, or it may be a special size insert. The individual signatures which compose the book are fed from corresponding hoppers or so-called pockets and the signatures for each book are eventually collected one atop another, or one aside another as the case may be, on a conveyor and are transported by the conveyor to a station in the machine where the signatures are joined into a book by stitching with staples or by gluing, depending on how the book is bound.

A signature gathering machine for composing a magazine may have up to thirty or more hoppers. This is especially so in the instance where various inserts are to be included at the proper place among the signatures in the course of gathering the signatures into a book.

It is now common for magazine editions to be subjected to so-called demographic controls. This is explained as follows. For the most part, signature gathering machines operate on the principle of zone mailing. For example, the signatures may be gathered on the basis of the entire mailing to a particular city, and such mailing will include the news stands, residential subscribers, institutional subscribers and so on in that particular zone. The books emitting from the machine are usually in alphabetical order for a particular zone. However, some publishers may require that there be so-called demographic separation of subscribers in terms of professional groups, student editions, and so on, regardless of zone. Demographic separation may be founded on such differences as subject matter content, advertisements, inserts and so on.

Production of these various editions complicates the signature machine in several respects. For example, the pocket feeders must be controlled to feed the proper signatures for the various editions. This aspect is discussed in McCain, U.S. Pat. Nos. 3,608,893 and 3,774,901.

Another problem with demographic editions is the books presented to the binding machine have variable thicknesses. Therefore, the binding machine must be capable of handling the variable book thicknesses. If, for example, the books are being stitched, the stitcher heads must apply proper compression to the saddle of the books. If there is too much compression, there will be a bulge in the back bone of the stitched book while if there is too little compression, the staple will be loose.

Conventionally, the stitcher heads are pre-set to accept one particular book thickness, the movable parts of the stitcher head descending the correct distance to properly engage a book of given thickness. But since the demographic editions will have variable thicknesses, fixed stitcher heads are subject to the errors mentioned above.

One approach to this problem is disclosed in U.S. Pat. No. 3,899,165. There the stitcher drive mechanism is adjusted for every book. In other words, the thickness of a book is determined and the stroke length of the stitcher head parts is adjusted accordingly so that each staple is properly formed. This technique does not lend itself to high speed production (on the order of five books per second). There is simply too much hardware to move accurately in the time available. Also, this method produces staples of improper length. This is because the stitcher head drive mechanism also controls the wire cutters that determine staple size. Since the wire is cut several book cycles in advance of driving it as a staple, adjustments made after cutting the wire will mean the wire is the wrong length for the newly-changed drive stroke.

Known stitcher heads are employed in the binding machine of the present invention. For example, Bostitch model 18001 stitcher heads may be used. These heads are supplied with wire from a spool. The length of wire from which the staple is formed is cut and positioned vertically in a groove of a swivel which is then turned to dispose the wire length in a horizontal position. Afterwards a bender bar shapes the wire to a U-form while the wire is held by the swivel. Next, a driver bar carries a related driver downwardly. The free end of the driver engages the swivel and causes it to be retracted. As the swivel is retracted, it releases the bent wire to a pivotal support member; the legs of the bent wire are supported by grooves in the bender bar. The driver and support member cooperate to square off the crown of the staple. Further descent of the driver bar and driver is characterized by the end of the driver engaging the support member to move the latter to a retracted position and at the same time the driver forces the wire into the book. The legs of the staple are clinched by fingers on the underside of the book.

SUMMARY OF THE INVENTION

This invention relates to a signature gathering system and in particular to a binding machine for such a system.

A primary object of the invention is a binding machine which is capable of binding books having different thicknesses without having to adjust the machine during operation.

Another object of the invention is a binding machine capable stitching books of variable thicknesses with the proper length staple.

Another object of the invention is a binding machine which stitches books of variable thickness and utilizes standard stitching heads to do so.

Another object of the invention is a binding machine capable of binding books of variable thickness while utilizing only a single drive mechanism.

These and other objects are achieved by a binding machine which has multiple binding stations. Each station is pre-set to bind a book of a given thickness. Each station is set up for a thickness which is different from every other station. The books are bound at the station corresponding to the particular book thickness. The stations are disabled when presented with a book having a thickness other than the one intended to be bound at that station.

DETAILED DESCRIPTION OF THE INVENTION

Figure 1:
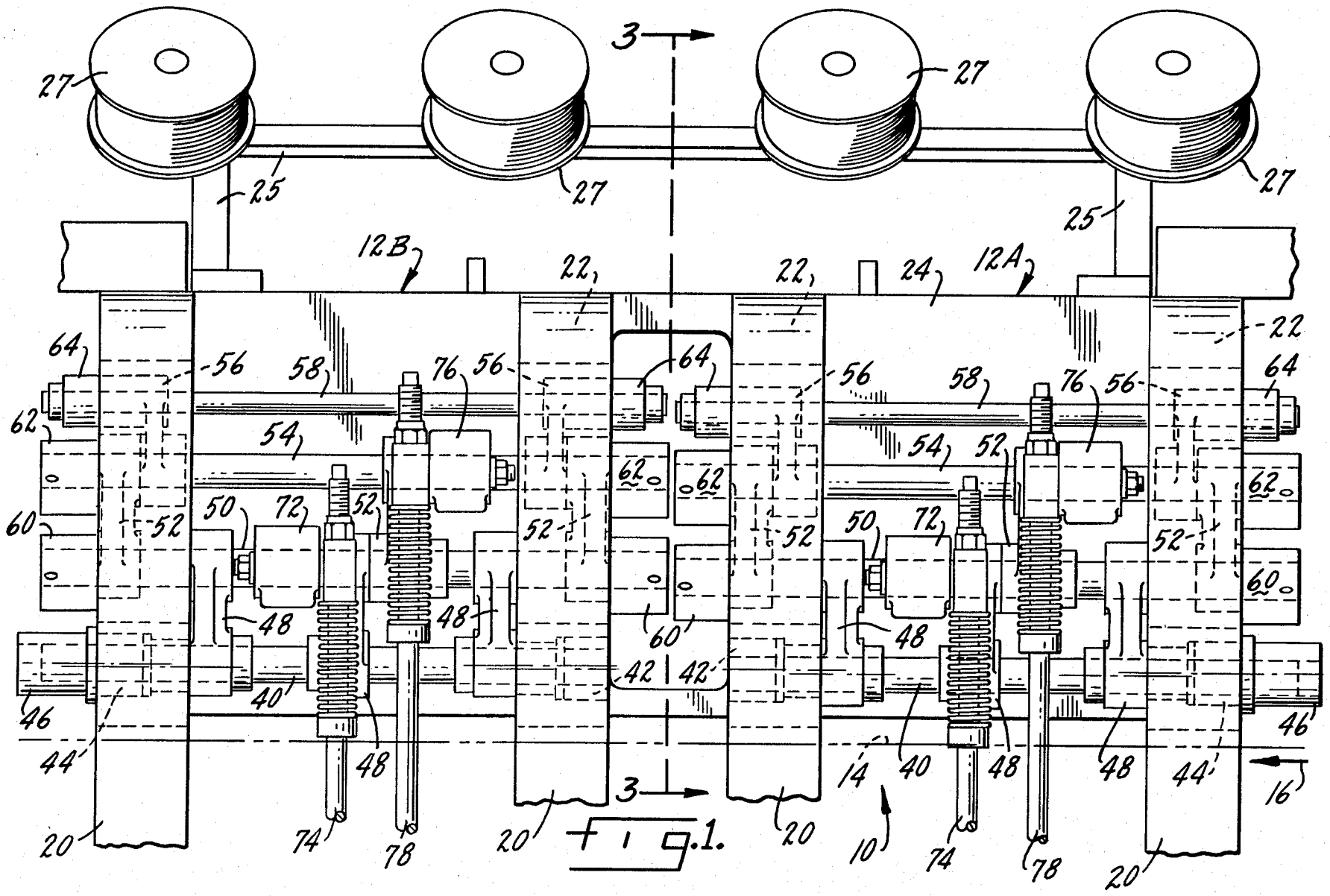
FIG. 1 is a rear elevation view of the drive mechanism of a stitcher according to the present invention.
Figure 2:
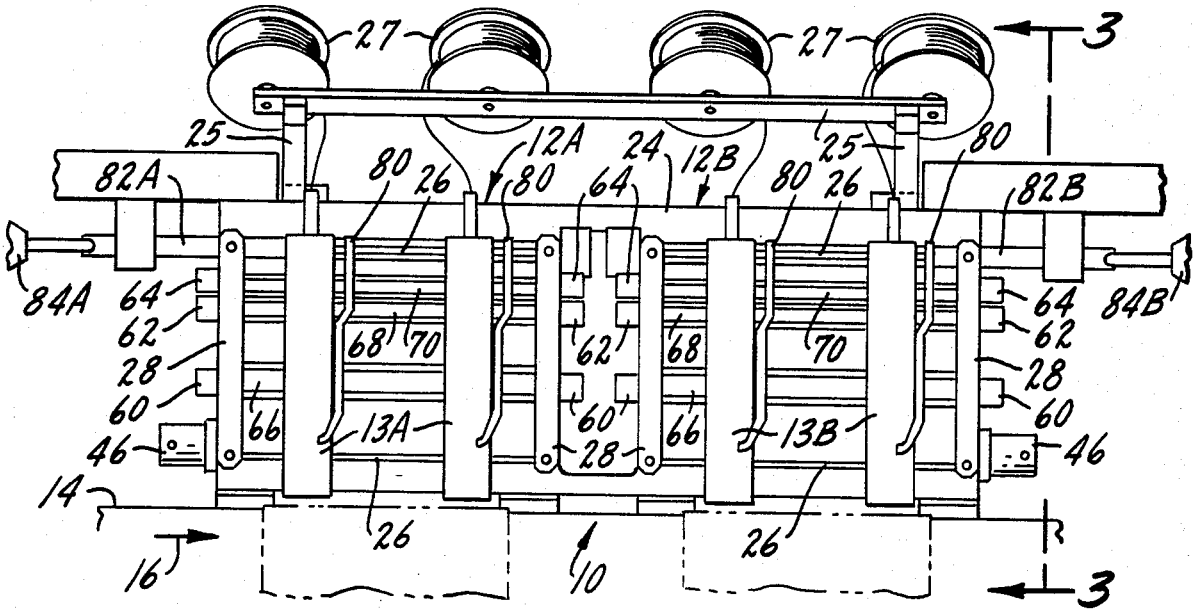
FIG. 2 is a front elevation view of a stitcher on a reduced scale.

FIGS. 1 and 2 illustrate a first form of the variable thickness stitcher according to the present invention. The stitcher 10 has multiple binding stations 12. In this case there are two binding stations 12A and 12B. The binding stations are intended for use with known stitcher heads, such as Bostitch Model 18001. The stitcher heads themselves are shown at 13 in FIGS. 2 and 3. Unbound books are fed to the binding machine 10 by a conveyor which includes a saddle 14. Books move in the direction of arrow 16.

The parts of the binding stations are virtually identical so common parts will be given the same reference numerals and only one of the binding stations will be described in the detail. The binding station has a frame 18 10 which includes two upright members 20. Each upright member includes two forwardly extending arms 22. A faceplate 24 is attached to the front of the arms 22. The faceplate may be formed as a single, integral part for both binding stations. The faceplate has two T-shaped slots 26 for mounting the stitcher heads. Brackets 25 mounted on the frame carry spools 27 of wire for the stitcher heads.

A pair of gib bars 28 are mounted to the faceplate 24 by four gib bar spacers 30. Various liners are mounted on the faceplate and gib bar in the space between them. There are drive liners 32, a drive slide bar liner 34, a bender slide bar plate 36 and an adjustment bar plate 38. These parts serve as bearings for the sliding parts, as will be described below.

A head adjustment eccentric shaft 40 is mounted in eccentric bearings 42 and 44. The bearings are mounted in the arm members 22 of the frame 20. The bearing 44 has an extension or collar 46 which extends beyond the edge of the frame members 20. The collar provides a convenient point for attaching a lever (not shown) which can be used to rotate the bearing. Each of the eccentric bearings has a bore drilled therethrough, off center from the center of the bearing outer diameter. The shaft 40 is rigidly mounted in these bores so that when the bearings 42 and 44 are manually rotated the shaft 40 will exhibit vertical and horizontal translation. It is the vertical translation which is used to adjust the stitcher head drive mechanism for variable book thicknesses.

Three drive slide bar shaft links 48 have one end mounted on the adjustment shaft 40. The other ends of the links 48 carry a bender linkage shaft 50. Both ends of the links 48 have bearings mounted therein so that the shafts can rotate in the links. The bender linkage shaft 50 carries three drive slide bar shaft links 52. A drive linkage shaft 54 is mounted in the opposite ends of the links 52. Again, there are bearings in the links 52 which allow the drive shaft 54 to rotate in the links. Two adjustment bar shaft links 56 are connected at one end to the drive shaft 54 and at the other end to an adjustment bar shaft 58. Thus, it can be seen that the bender shaft 50, the drive shaft 54 and the adjustment bar shaft 58 are linked to the head adjustment eccentric shaft 40 by means of the various links 48, 52 and 56. Rotation of the eccentric bearings 42 and 44 will then alter the positions of the shafts 50, 54 and 58.

The ends of the bender shaft 50, drive shaft 54 and adjustment shaft 58 extend beyond the upright frame members 20. The bender shaft 50 carries drive arms 60 rigidly connected at each end of the shaft. Similarly, drive shaft 54 carries rigidly mounted drive arms 62 at each end. And adjustment bar shaft 58 has adjustment bar arms 64 at each end. The adjustment bar arm has one end connected to the frame 20 and is mounted for rotation about the shaft 58.

The ends of the drive arms which extend away from the frame each are fitted with bearings which receive the ends of the various slide bars. The bender bar arms 60 carry the ends 65 of the bender slide bar 66. The drive arms 62 carry the ends 67 of the drive slide bar 68 while the adjustment arms 64 carry the ends 69 of the adjustment bar 70 (see FIG. 2). These three slide bars slide on the liners between the faceplate 24 and the gib bars 28. It will be understood that the slide bars are connected to the bender bar, drive bar and adjustment bar of the stitcher heads.

The bender shaft 50 is driven by an operating arm 72 which is connected to a bender bar rod 74. The rod 74 extends to a cam (not shown) which actuates the operating arm 72 at the appropriate time. A similar linkage having an operating arm 76 and a driver bar rod 78 actuates the driver shaft 54. The driver bar rod is also actuated by a cam which is not shown but is conventional.

FIG. 2 is a schematic representation of a dual station stitching machine according to the present invention. Station 12A has two stitcher heads 13A and station 12B has stitcher heads 13B. Each stitcher head is equipped with a disabling mechanism including a lever 80 connected to a disabling bar. Station 13A has a solenoid 84A connected to the disabling bar 82A. Similarly, the disabling bar 82B is connected to a solenoid 84B. Further details of a stitch disabling mechanism are shown in McCain U.S. Pat. Nos. 3,191,925 and 3,305,154. Also, reference is made to Bulka U.S. Pat. No. 3,876,129 for further details of the stitcher heads.

The operation of the variable thickness stitcher is as follows. Since the multiple stitcher or binding stations are independently adjustable, the stations are set up prior to operation of the binding machine to handle books of different thicknesses. In the embodiment shown this is done by rotating the eccentric bearings 42 and 44. When these bearings rotate they alter the height of the eccentric shaft 40. This changes the height of the shafts 50, 54 and 58 by means of the links 48, 52 and 56. As a consequence of the shafts' movement, the positions of the slide bars 66, 68 and 70 change by means of the drive arms 60, 62 and 64. Changing the positions of the slide bars necessarily changes the top and bottom positions of a stitcher stroke. While the stroke length remains constant, the vertical location of the stroke relative to the conveyor saddle changes after rotation of the eccentric bearings 42 and 44. Thus, the compression the stitcher head components exert on books of a given thickness can be adjusted to the proper amount. Or, to state it differently, the book thickness that will properly fit between the stitcher head components (at bottom dead center) and the saddle can be selected by means of the eccentric bearings 42 and 44.

With stitching station A set up to handle one book thickness and station B set up to handle a different thickness, operation of the binding machine begins. A caliper determines the book thickness prior to the time it enters the first binding station. If it is the proper thickness for the first station, the stitcher heads operate in their normal manner and bind the book. When that book proceeds to the second binding station the stitcher heads at that station will be disabled so no further staples are added to the already-bound book. The book then leaves the second binding station.

If a book entering the binding machine is not the proper thickness for station A, the stitcher heads at that station are disabled and the unbound book proceeds to station B where the stitcher heads operate normally and bind the book. So as a given book proceeds through the binding machine it will be bound at one station or the other depending on instructions to the stitcher from the caliper. In this manner the binding machine can handle more than one book thickness but the stitcher head drive mechanism need not be adjusted during operation of the machine. While two binding stations have been shown and described, it will be understood that additional binding stations could be added to the binding machine as needed.

Figure 3:
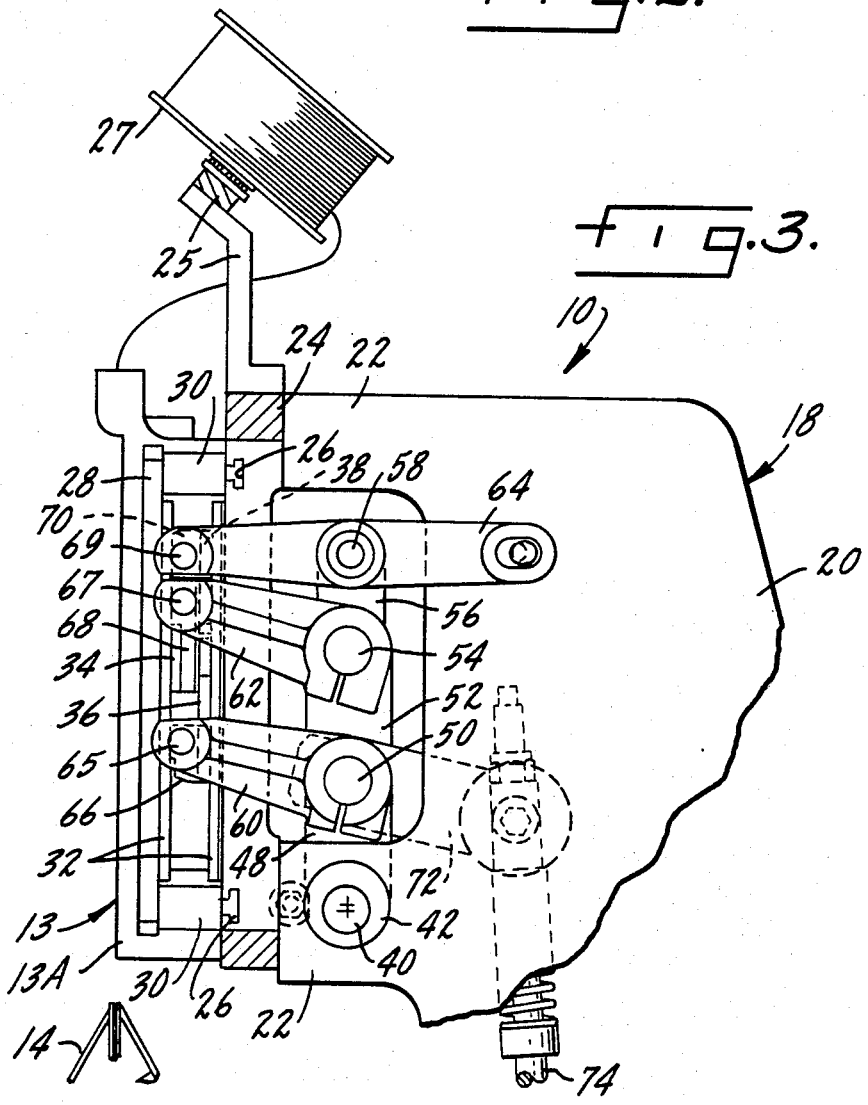
FIG. 3 is a section taken along line 3—3 of FIG. 1.
Figure 4:
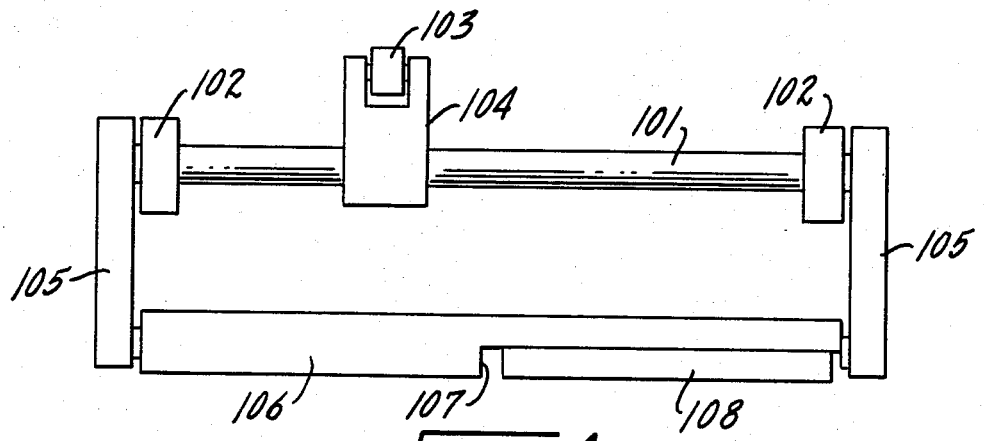
FIG. 4 is a schematic plan view of an alternate form of a variable thickness stitcher.

FIG. 4 is a schematic plan view of an alternate embodiment. The sketch shows only a single drive shaft and drive slide bar. It will be understood that an actual machine would include three similar mechanisms; one each for the bender bar, the drive bar and the adjustment bar. The embodiment shown includes a shaft 101 mounted for rotation in links 102. The links are connected to an eccentric shaft (not shown) in the same manner as described in connection with FIGS. 1–3. The shaft 101 is driven by a rod 103 which is connected to the link 104. Drive arms 105 are rigidly connected to the shaft 101 at either end thereof. All of the parts described to this point may be essentially the same as the ones illustrated in detail in FIGS. 1–3.

The variation from FIGS. 1–3 resides in the slide bars. Instead of having a single bar connected to the ends of the drive arms, there is an articulated slide bar. A first portion of the articulated slide bar 106 extends between the drive arms 105 and is connected to the ends of the drive arms. It has a cut out area 107 which accommodates a slide bar insert 108. The insert 108 is adjustable with respect to the first portion 106. For example, vertically elongated slots could be provided in the bar 106. Attachment elements connected to the insert 108 would be slidable in the slots and they could be tightened when the insert 108 was placed at the desired position. The first portion 106 and the insert 108 engage the driven parts of stitcher heads of different binding stations. The articulated slide bar allows the drive strokes of the heads to have different top and bottom positions, i.e. the vertical location of the drive strokes, relative to the saddle, is different. Thus, although a single drive is used, the stitcher heads attached to the bar 106 can be set for a different thickness than the ones attached to the insert 108. It can be seen that this embodiment has two adjustment mechanisms. First, the eccentric shaft which will adjust both sets of heads and second, the insert 108 which will adjust only the heads attached to it. Separate disabling mechanisms would be provided for each set of stitcher heads.

Figure 5:
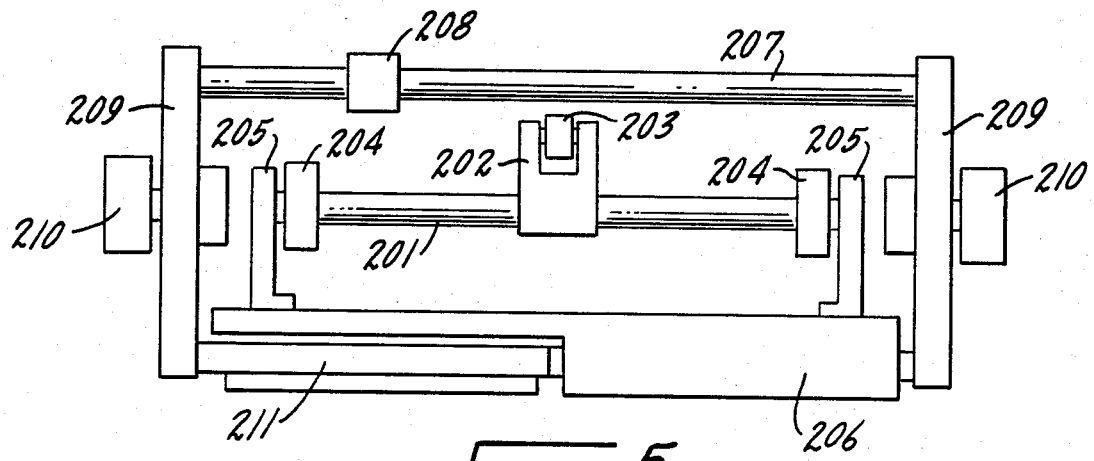
FIG. 5 is a schematic plan view of a further alternate embodiment of the variable thickness stitcher.

FIG. 5 shows a further alternate embodiment. As in FIG. 4 only one set of drive slide bars is shown. Basically this embodiment has one drive mechanism physically contained within a second drive mechanism. The interior drive includes a shaft 201 connected by a link 202 to a drive rod 203. The shaft 201 is mounted to an eccentric adjustment shaft (not shown) by links 204. As in the other embodiments the shaft 201 rotates within bearings held by the links 204. The ends of the shaft 201 carry drive arms 205. These drive arms 205 in turn have a drive slide bar 206 mounted on the ends thereof. The drive slide bar 206 attaches to the driven parts of a stitcher head.

The outer drive includes a shaft 207. A drive 208 actuates shaft 207. Drive arms 209 are connected to the shaft 207. The arms 209 may be mounted to adjustment links 210. These links extend to an eccentric adjustment shaft (not shown) which is in the same vertical plane as the eccentric adjustment shaft for the inner drive but is in a different horizontal plane. A slide bar 211 is connected to the ends of the drive arms 209. The slide bars 206 and 211 are arranged to mesh such that they can operate without interference with each other. In this embodiment each binding station has its own eccentric shaft for adjustment purposes.

We claim:

1. In a signature machine for assembling books, a plurality of signature feeders for feeding signatures onto a conveyor which advances unbound books to a binding machine, the improvement comprising a binding machine which can accommodate variable book thicknesses without adjustment during operation, the binding machine having multiple binding stations, each book being bound at one of the stations, the binding stations being independently adjustable such that each station can be set up prior to operation of the binding machine to bind books of a given thickness which is different from the thicknesses of books stitched at the other stations.

2. The binding machine of claim 1 wherein the binding machine comprises a frame, at least two stitching heads attached to the frame for each station, drive means for actuating the stitching heads and means for adjusting the compression exerted by the stitcher heads on a book.

3. The binding machine of claim 2 wherein there are separate drive means for each station and separate adjusting means for each station.

4. The binding machine of claim 2 having a single drive means for two binding stations, said drive means including at least one articulated slide bar which has a first portion and an insert portion adjustably mounted on the first portion, the first portion and insert portions being connected to the stitcher heads of different binding stations.

* * * * *